United States Patent [19]

Carey, Jr. et al.

[11] Patent Number: 4,667,354

[45] Date of Patent: May 26, 1987

[54] TILTING UPPER BODY SUPPORT PATIENT TROLLEY

[75] Inventors: John S. Carey, Jr., Crofton, Md.; Wolfgang Jung, Arlington; Theodore A. Varouxis, Annandale, both of Va.

[73] Assignee: Siemens Corporate Research and Support Inc., Iselin, N.J.

[21] Appl. No.: 121,546

[22] Filed: Feb. 14, 1980

[51] Int. Cl.[4] ..... A61G 7/00

[52] U.S. Cl. ..... 5/72; 5/64; 5/66; 248/654; 297/330; 297/354

[58] Field of Search ..... 5/62, 63, 64, 66, 68, 5/81 R, 61, 67, 69, 70, 71, 72; 269/323; 254/93; 250/439 R; 108/7; 248/654; 297/330, 354

[56] References Cited

U.S. PATENT DOCUMENTS

| | | | |
|---|---|---|---|
| 2,168,649 | 8/1939 | Johnson | 5/69 |
| 2,540,133 | 2/1951 | Miller | 5/69 |
| 2,632,898 | 3/1953 | Pardoe | 5/66 |
| 2,687,536 | 8/1954 | Miller | 5/69 |
| 2,788,529 | 4/1957 | Moritzacky et al. | 5/72 |
| 3,174,162 | 3/1965 | Sinton | 5/503 |
| 3,191,195 | 6/1965 | Schlackman et al. | 5/66 |
| 3,304,116 | 2/1967 | Stryker | 5/81 R |
| 3,311,933 | 4/1967 | Peterson | 5/63 |
| 3,579,671 | 5/1971 | Kotter | 5/63 |
| 3,724,003 | 4/1973 | Ellwanger et al. | 5/68 |
| 3,902,204 | 9/1975 | Lee | 5/81 B |

*Primary Examiner*—Alexander Grosz

[57] ABSTRACT

A patient trolley has a tiltable upper body support which is hydraulically lifted to a raised "heart" position and which is immediately lowered by a quick release valve so that a patient may be quickly treated in a horizontal position. Two cylinders are mounted on trunnions with distal ends of pistons interconnected to upper body supports so that the cylinders extend downward and toward a head end of the trolley from the trunnions. As the upper body support is lifted the cylinders rotate on the trunnions toward the head end of the trolley. In the down position of the upper body support the cylinders and trunnions may be lifted and held in an inactive position for clearance of hospital equipment. Levers and linear bearings enable the upper body support to be raised to substantially perpendicular position and to be quickly lowered.

21 Claims, 10 Drawing Figures

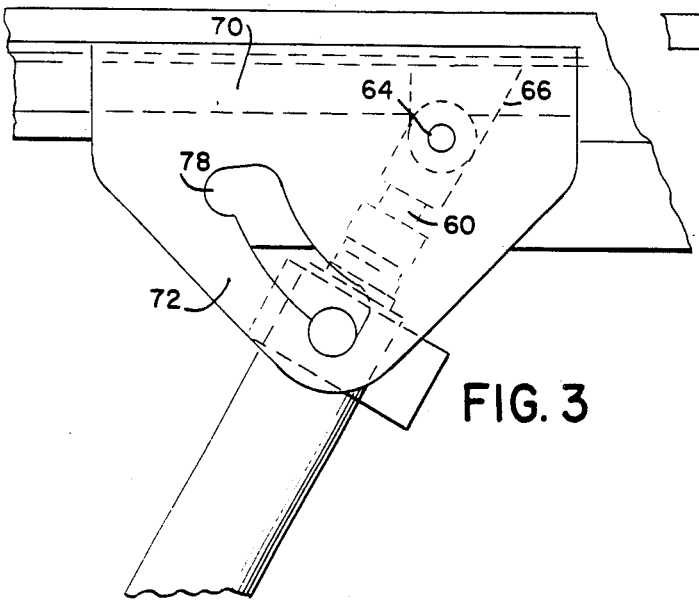
FIG. 3
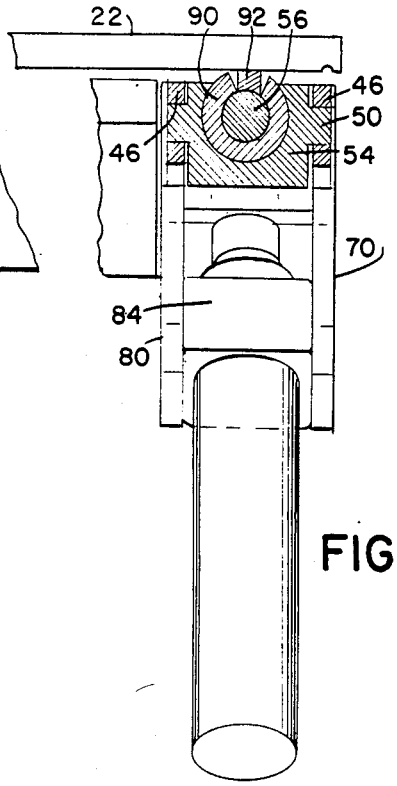
FIG. 5
FIG. 4
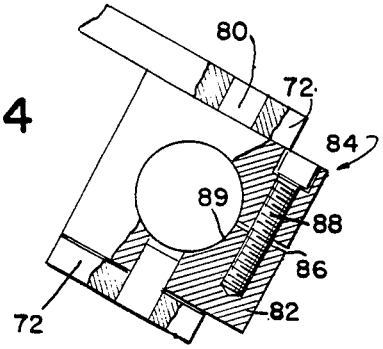
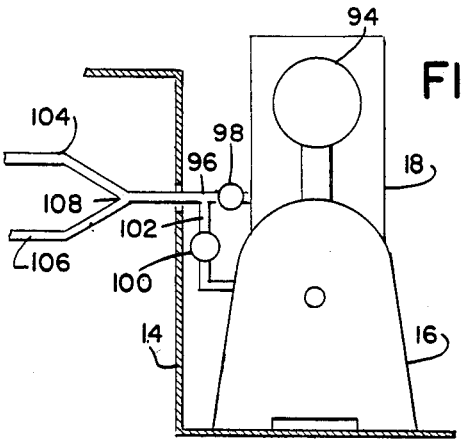
FIG. 7
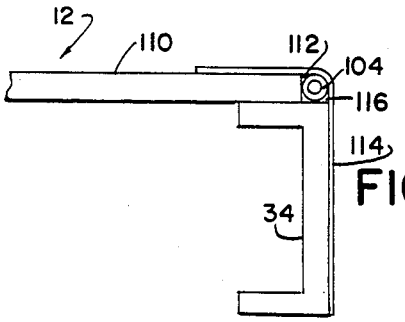
FIG. 8

TILTING UPPER BODY SUPPORT PATIENT TROLLEY

BACKGROUND OF THE INVENTION

Patient trolleys are well known. Patient trolleys, also referred to as hospital stretchers, usually have a base with four wheels. Vertical support members rise upward from the base and are connected to horizontal members on which a patient support table is connected. The vertical members may be adjustable to vary the height and inclination of the patient support table.

Highly desirable trolleys or hospital stretchers are configured so that the patient support table may be positioned over operating room pedestals or between X-ray sources and film holders. Some trolleys or stretchers have tiltable upper body supports.

A patient trolley is described in an eight page Siemens brochure entitled "Patient Transport Trolley—PTT-R." That particular trolley has an upper body support which is hinged to a patient table and which may be manually lifted and supported by manually positioned angular braces.

A hospital stretcher in which an upper body support is raised by a screwed jack is shown in U.S. Pat. No. 3,341,246.

The devices of the prior art have drawbacks in that when heavy patients are served, it is difficult to raise the upper body of the person manually or with known apparatus such as the screw jacks. Notwithstanding the difficulty, great effort may be expended by two or more attendants to raise the upper body support when it is desired to maintain a patient in such a position.

During emergency conditions which do not occur during the use of such trolleys or stretchers it is extremely important to quickly lower the patient to a complete horizontal position for emergency treatment. The desirable elevated position is particularly useful for heart patients and is often referred to as the "heart" position. Such patients are susceptible to cardiac arrest, which requires immediate treatment in a horizontal position. Thus, it is necessary to be able to easily raise and rapidly lower an upper body support on such trolleys and stretchers.

In supports which are manually raised and which use braces, several attendants may be required to lift the support while the braces are removed. In screw jack type of supports valuable time may be lost in continuous turning of a handle to lower the upper body support.

Devices such as screw jacks may make the compatibility of stretchers with existing hospital equipment impossible.

SUMMARY OF THE INVENTION

The present invention provides an easily raised and rapidly lowered upper body support for a hospital stretcher or patient trolley. The present invention overcomes problems with prior art and other problems such as the difficulty in devices of types similar to the screw jack in which the initial raising of the loaded upper body support is extremely difficult.

The patient trolley of the present invention has a tiltable upper body support which is hydraulically lifted to a raised "heart" position and which is immediately lowered by a quick-release valve so that a patient may be quickly treated in a horizontal position. Two cylinders are mounted on trunnions with distal ends of pistons interconnected to upper body supports so that the cylinders extend downward and toward a head end of the trolley from the trunnions. As the upper body support is lifted the cylinders rotate on the trunnions toward the head end of the trolley. In the down position of the upper body support the cylinders and trunnions may be lifted and held in an inactive position for clearance of hospital equipment. Levers and linear bearings enable the upper body support to be raised to substantially perpendicular position and to be quickly lowered.

Patient trolley apparatus of the invention has a frame, wheels connected to a bottom of the frame, vertical support members connected to the frame and horizontal support members connected to the vertical support members. A patient supporting table is connected to the horizontal support members. Hinges connect an upper body support to the table, and means hold the upper body support in angular relationship with the patient table. An auxiliary frame is connected to the apparatus along one end. A hydraulic reservoir and a hydraulic pump are mounted on the auxiliary frame. First and second ram mounts are mounted on opposite sides of the table; first and second pivot pins respectively are connected to the ram mounts. First and second hydraulic cylinders respectively are connected to the first and second pivot pins. First and second pistons mounted in the cylinders have distal ends interconnected to the upper body support. Hydraulic lines interconnect the cylinders and the pump, and a quick-release valve releases pressure in the cylinders to immediately drop the upper body support.

The ram mounts are first and second bracket assemblies connected to the table means. Each bracket assembly has first and second parallel plates with mounts for connection to the table means and arcuate recesses for receiving the pins. The arcs of the recesses are centered on connections at distal ends of the pistons. The arcuate recesses have indentations at opposite ends thereof for holding the pins in the indentations. The rams are held by trunnion assemblies; each trunnion assembly having a collar for tightly engaging an upper end of one of the cylinders and having trunnion pins extending outward in opposite directions for engaging the ram mounts.

Preferably the upper body support is interconnected to distal ends of the pistons by first and second levers and first and second slides respectively connected to levers. Each lever has a proximal end pivotally connected to a side of the table and a distal end for connecting via a slide to a side of the upper body support. The distal end of one of the pistons is pivotally connected to the lever intermediate its proximal and distal ends. A piston is connected to each lever at a position nearer its proximal end than its distal end.

The slide means includes a rod having a smooth exterior finish connected to the upper body support and a linear bearing assembly connected to the distal end of each lever and at least partially surrounding the rod. The linear bearing assembly includes a clevis connected to the distal end of each lever, the clevis having opposite holes near distal ends thereof, a bearing trunnion having outward extending pins fitting in the holes and having a bearing insert receiving portion and a linear bearing insert mounted within the bearing insert receiving portion.

The hinges include first and second downwardly extending brackets mounted at opposite sides of the upper body support and pins extending through the bracket and into opposite sides of the table. The pins are spaced along the table means from the proximal ends of the levers in directions opposite the distal ends of the levers.

The table includes first and second longitudinally extending lateral support members and a slab fixed on top of the support members. The slab has lateral edges positioned slightly inward from lateral extremities of the support members. Fairings cover the lateral support members and ends of the slab, thereby forming longitudinally extending passages between the fairings and opposite lateral edges of the slabs. Hydraulic lines are positioned in the passages.

The hydraulic lines include a pump output line having a check valve for permitting flow outward from the pump and a return line connected to the output line outward of the check valve and connected to the reservoir. The quick release valve is mounted in the return line. A "Y" connection on the output line connects first and second parallel lines to the outptu line, and the parallel lines are respectively connected to the first and second cylinders.

In one embodiment distal ends of the pistons are directly connected to the upper body support. Preferably, distal ends of the pistons are interconnected to the upper body support via linkage which permits the upper body support to be rotated upward through intermediate positions to a position perpendicular to the table means.

The hydraulic cylinders are mounted at an acute angle to the table means, and the cylinders extend downward and toward a head end of the table means. The cylinders may be rotated upward to an inoperative position and may be held in the inoperative upward position.

The method of using the patient trolley of the present invention includes pumping a hydraulic pump and driving pistons from cylinders and thereby rotatably raising an upper body support on the patient trolley to an upright position, and turning a valve and immediately releasing the pistons to move backward into the cylinders and thereby dropping the upper body support to the position substantially in horizontal alignment with a table on the patient trolley.

The above further features and objects of the invention are apparent in the disclosure. The disclosure is the above and below specification, which includes the claims and the drawings.

BRIEF DESCRIPTION OF THE DRAWINGS

FIG. 3 is a detail of the ram mounting means.

FIG. 4 is a detail of the cylinder mounting trunnion which is used with the ram mount shown in FIG. 3.

FIG. 5 is a detail of the slide assembly and ram mounting trunnion.

FIG. 7 is a schematic hydraulic diagram showing the pump reservoir, check valve and quick release valve used in the present invention.

FIG. 8 is a cross-sectional detail of the positioning of the hydraulic lines.

DETAILED DESCRIPTION OF THE DRAWINGS

Figure 1:
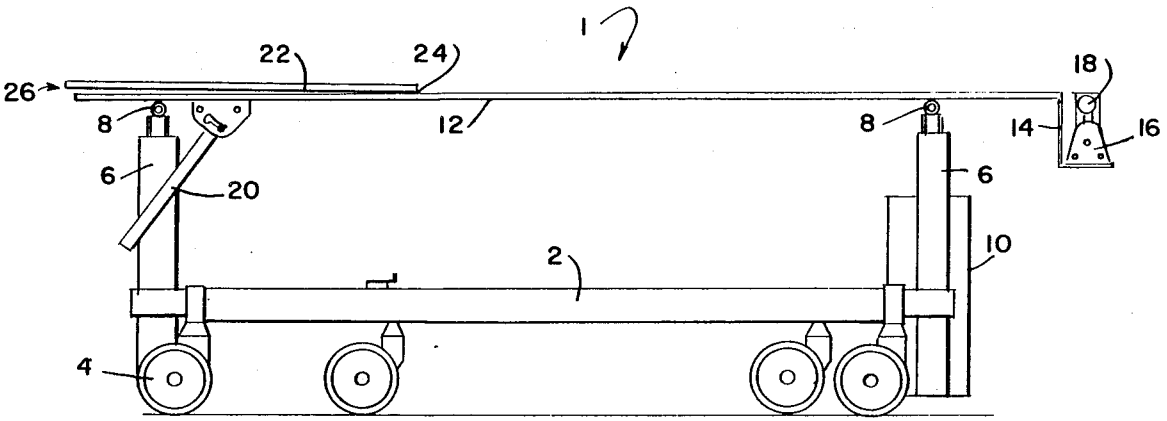
FIG. 1 is a schematic side elevation of a patient trolley with a tilting upper body support of the present invention.

Referring to FIG. 1, a patient trolley is generally indicated by the numeral 1. The patient trolley has a frame 2 supported by wheels 4. Vertical support members 6 are connected to the frame and horizontal support members 8 are connected to an upper end of the vertical support members. The vertical support members may be cylinders which are supplied by pumps and reservoirs 10 to raise the horizontal support members 8. A patient support table means 12 which may include beams and a slab is mounted on the support members 8. An auxiliary frame 14 is mounted at one end of the patient support table 12. On the auxiliary frame is mounted a reservoir 16 and a pump 18 which support hydraulic fluid to a pair of cylinders 20 which drive pistons to rotate upper body support 22 about pin means 24.

As shown in FIG. 1, the cylinder 20 is connected in such a way that it slopes downward and toward a head end 26 of table 12. The cylinder 20 is positioned substantially adjacent one of the vertical support members 6 so that the cylinder does not encounter hosiptal equipment to which the trolley is juxtaposed. Specifically, the cylinder does not interfere with an operating room pedestal which the U-shaped trolley frame 2 partially surrounds when transferring table 12 to the pedestal.

Cylinder 20 does not interfere with film holders which are positioned beneath table 12 during X-ray procedures. As later will be explained, the cylinder 20 may be rotated upward to even further remove the cylinder from interference with film holders or similar equipment.

Figure 2:
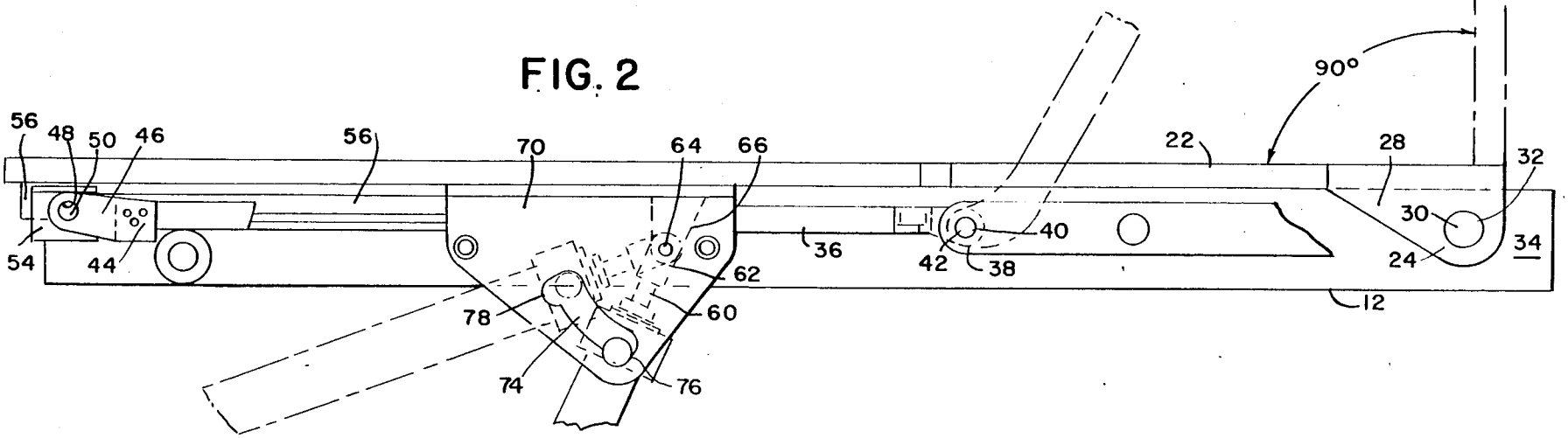
FIG. 2 is a detail of the tilting upper body support.

As shown in FIG. 2, the upper body support 22 is hinged to the table 12 as shown at 24. Brackets 28 are connected to opposite sides of the upper body support 22 at an end remote from the head end and pins 30 extend through holes 32 in their brackets into lateral support beams 34 of table 12.

In one model as later will be described, the piston is attached directly to a pivot on the upper body support. Preferably, as shown in FIG. 2, on each side of the upper body support a lever 36 has a proximal end 38 with a hole 40 through which passes pin 42 to rotatably secure the lever to lateral support beam 34. The distal end 44 of the lever is provided with a clevis 46 with holes 48 which receive trunnion pins 50 of a bearing holder 54. A bearing insert within the holder rides along rod 56 which is secured beneath the upper body support 22 in parallel relation thereto. A distal end 62 of a piston 60 is connected with a pin 64 to a lug 66 on lever 36. As shown in the drawings, lug 66 is closer to the proximal end 38 than to the distal end 44 of lever 36.

On each side of the table 12 a ram mount bracket assembly 70 is mounted. Each bracket assembly has two parallel plates 72 which are connected to each other and to the lateral support beam 34 of table 12. An arcuate opening 74 in each plate 72 is formed with radii extending through the axis of pin 64 when the upper body support member 22 is in a horizontal position. The arcuate recess 74 has indentations 76 and 78 at opposite ends thereof. Trunnion pins 80 connected to cylinder holding collars 82 rest in the indentations. Specifically the trunnion pins 80 rest in indentations 76 when the cylinder 20 is in its operative position. The cylinders may be slightly compressed as shown in FIG. 3 and lifted and then slightly extending so that the trunnions become lodged in indentations 78 to hold the cylinders in an upward position for clearance of hospital equipment.

Trunnion assemblies 84 are shown in FIG. 4. The trunnion assemblies include the oppositely extending trunnion pins 80 which extend through the parallel plates 72 of the bracket assembly. Pins 80 are mounted in collar 82 which has a split 86 and a threaded bolt 88 to tighten the collar on a cylinder 20 which is received within opening 89.

The ram mount bracket assembly 70 and bearing assembly 54 are shown in FIG. 5. Bearing assembly 54 has trunnion pins 50 which extend through openings in clevis 46 on the distal end of the lever 36. Linear bearing insert 90 which is held in bearing assembly 54 partially surrounds rod 56, which is supported on strip 92 slightly spaced beneath lateral edge portions of upper body support member 22.

Figure 6:
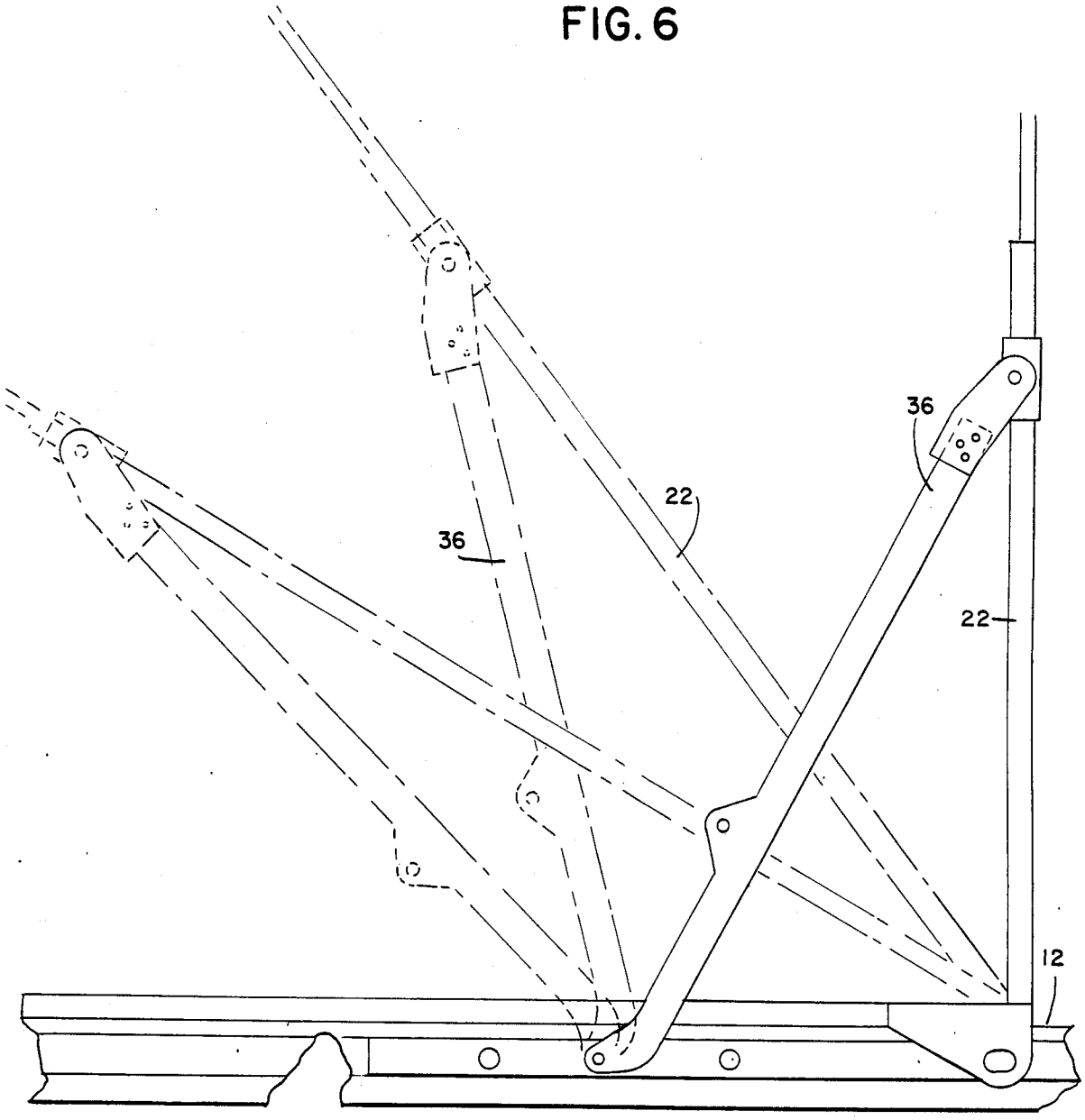
FIG. 6 is a detail of the lever and slide adjustment to an upward position of the upper body support.

FIG. 6 shows intermediate positions of lever 36 and upper body support 22 and the fully extended position of lever 36 in which the upper body support 22 is substantially perpendicular to table 12.

FIG. 7 shows schematically the reservoir 16 and pump 18 mounted on auxiliary Z-shaped frame member 14. Operating lever 94 drives the pump to flow hydraulic fluid outward through outlet line 96 and check valve 98. Quick-release valve 100 in return line 102 may be opened at any time to immediately exhaust parallel hydraulic lines 104 and 106 connected at "Y" 108 to immediately drop the upper body support 22.

As shown in FIG. 8, the table 12 includes a lateral support beam 34 and a table slab 110. Edge 112 of the table slab is positioned slightly inwardly of the outer surface of beam 34. Fairing 114 covers the beam and the outer edge of the table slab 110 and forms an enclosed recess 116 through which one of the hydraulic lines 104 passes. A similar recess is formed at the other side of the table slab 110 so that line 106 passes therethrough. This protects the hydraulic lines from exposure, abrasion, damage, and rupture. At the desired point, hydraulic line 104 passes through an opening in the fairing and is connected to a port near the bottom of one of the cylinders 20.

Figure 10:
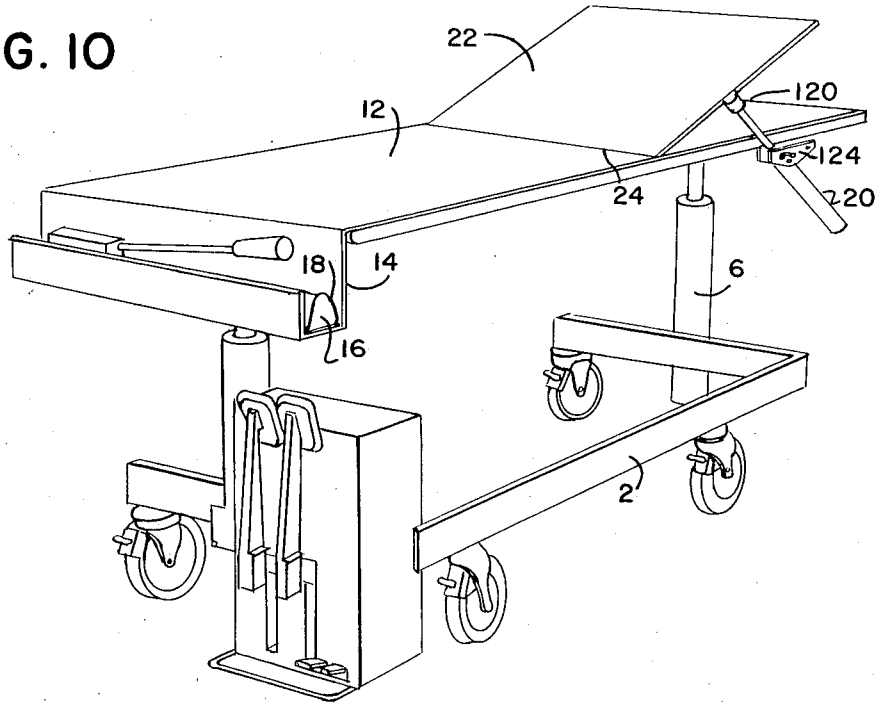
FIG. 10 is a detail of the hospital trolley with the upper body support as shown in FIG. 9.
Figure 9:
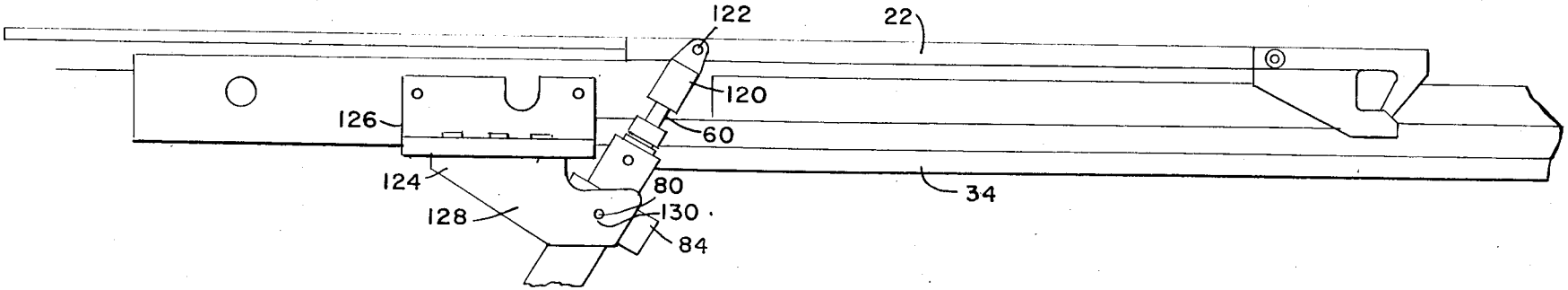
FIG. 9 is a detail of a second embodiment of the invention wherein the piston is connected directly to a pivot mounted on the upper body support.

In a modified form of the invention as shown in FIGS. 9 and 10, the distal end of piston 60 is connected to an L-shaped member 120 which is connected by a pivot pin 122 directly to a side of upper body support 22. Cylinder mount 124 has an upper portion 126 which is connected directly to lateral support beam 34 and a slightly outward extending lower member 128 which has a hole 130 to receive trunnion pin 80 of trunnion assembly 84. Pressurizing cylinder 20 drives piston 60 outward and raises upper body support 22 to the extent of the stroke of the piston, which is about 12 inches.

While the invention has been described with reference to specific embodiments, it will be obvious to those skilled in the art that modifications and variations may be constructed without departing from the scope of the invention. The scope of the invention is defined in the following claims.

I claim:

1. In patient trolley apparatus having a frame, wheels connected to a bottom of the frame and vertical support members connected to the frame and horizontal support members connected to the vertical support members, a patient supporting table means connected to the horizontal support members and an upper body support, hinge means for connecting the upper body support to the patient table means and means for holding the upper body support in angular relationship with the patient table means, the improvement comprising an auxiliary frame connected to the apparatus along one end thereof, a hydraulic reservoir and a hydraulic pump mounted on the auxiliary frame, first and second ram mounting means mounted on opposite sides of the table means, first and second pivot pin means respectively connected to the ram mounting means, first and second hydraulic cylinders respectively connected to the first and second pivot pin means, first and second pistons mounted in the cylinders, the pistons having distal ends respectively interconnected to the upper body support, hydrualic lines interconnecting the cylinders and the pump and means for adjusting the angular position of said cylinders and pistons relative to the table means by lifting the cylinders and holding the cylinders in an upward position for clearance of hospital equipment absent hydraulic actuation of said pistons.

2. In patient trolley apparatus having a frame, wheels connected to a bottom of the frame and vertical support members connected to the frame and horizontal support members connected to the vertical support members, a patient supporting table means connected to the horizontal support members and an upper body support, hinge means for connecting the upper body support to the patient table means and means for holding the upper body support in angular relationship with the patient table means, the improvement comprising an auxiliary frame connected to the apparatus along one end thereof, a hydraulic reservoir and a hydraulic pump mounted on the auxiliary frame, first and second ram mounting means mounted on opposite sides of the table means, first and second pivot pin means respectively connected to the ram mounting means, first and second hydraulic cylinders respectively connected to the first and second pivot pin means, first and second pistons mounted in the cylinders, the pistons having distal ends respectively interconnected to the upper body support, hydraulic lines interconnecting the cylinders and the pump and quick-release valve means connected to the hydraulic lines for releasing pressure in the cylinders to immediately drop the upper body support, wherein the ram mounting means comprise first and second bracket assemblies connected to the table means, each bracket assembly comprising first and second parallel plates having mounting means for connection to the table means and having arcuate recesses for receiving the pin means.

3. The apparatus of claim 2 wherein the arcuate recesses are situated to allow pin means to extend through the parallel plates without obstructing arcuate movement of said pins when said pistons are pivoted about their distal ends.

4. The apparatus of claim 3 wherein the arcuate recesses have indentations at opposite ends thereof for holding the pin means in the indentations.

5. In patient trolley apparatus having a frame, wheels connected to a bottom of the frame and vertical support members connected to the frame and horizontal support members connected to the vertical support members, a patient supporting table means connected to the horizontal support members and an upper body support, hinge means for connecting the upper body support to the patient table means and means for holding the upper body support in angular relationship with the patient table means, the improvement comprising an auxiliary frame connected to the apparatus along one end thereof, a hydraulic reservoir and a hydraulic pump mounted on the auxiliary frame, first and second ram mounting means mounted on opposite sides of the table means, first and second pivot pin means respectively connected to the ram mounting means, first and second hydraulic cylinders respectively connected to the first and second pivot pin means, first and second pistons mounted in the cylinders, the pistons having distal ends respectively interconnected to the upper body support, hydraulic lines interconnecting the cylinders and the pump wherein the pivot pin means comprise first and second trunion assemblies, each trunion assembly comprising a collar for tightly engaging an upper end of one of the cylinders and the collar having trunion pins extending outward thereof in opposite directions for engaging the ram mounting means, and plates connected to the table means, the plates having openings for receiving the trunion pins in operative positions of the cylinders and having second openings for receiving the trunion pins to hold the cylinder upward in non-operative positions of the cylinder.

6. In patient trolley apparatus having a frame, wheels connected to a bottom of the frame and vertical support members connected to the frame and horizontal support membes connected to the vertical support members, a patient supporting table means connected to the horizontal support members and an upper body support, hinge means for connecting the upper body support to the patient table means and means for holding the upper body support in angular relationship with the patient table means, the improvement comprising an auxiliary frame connected to the apparatus along one end thereof, a hydraulic reservoir and a hydraulic pump mounted on the auxiliary frame, first and second ram mounting means mounted on opposite sides of the table means, first and second pivot pin means respectively connected to the ram mounting means, first and second hydraulic cylinders respectively connected to the first and second pivot pin means, first and second pistons mounted in the cylinders, the pistons having distal ends respectively interconnected to the upper body support, hydraulic lines interconnecting the cylinders and the pump and quick-release valve means connected to the hydraulic lines for releasing pressure in the cylinders to immediately drop the upper body support, wherein the upper body support is interconnected to distal ends of the pistons by first and second levers and first and second slides respectively connected to levers, each lever comprising a proximal end pivotally connected to a side of the table means and a distal end for connecting via the slide means to a side of the upper body support and wherein the distal end of a respective one of the pistons is pivotally connected to the lever intermediate the proximal and distal ends.

7. The apparatus of claim 6 wherein one of the pistons is connected to each lever at a position nearer the proximal end than the distal end.

8. The apparatus of claim 6 wherein the hinge means comprises first and second downwardly extending brackets mounted at opposite sides of the upper body support and pins extending through the bracket and into opposite sides of the table means, wherein the pins are spaced proximally from the proximal ends of the levers.

9. The apparatus of claim 1 wherein the distal end of each piston is directly connected to an L-shaped member which is connected by a pivot pin to the upper body support.

10. The apparatus of claim 1 wherein the auxiliary frame is connected to one end of the table means.

11. The apparatus of claim 10 wherein the auxiliary frame comprises a Z frame having a flat vertical intermediate portion with two flat horizontal portions connected at right angles to opposite edges of said vertical intermediate portion extending in opposite directions constituting an upper portion and a lower portion and having the upper portion connected to an under side of an end of the table means and having a lower portion supporting the hydraulic reservoir and hydraulic pump.

12. The apparatus of claim 1 wherein the distal ends of the pistons are interconnected to the upper body support via linkage which permits the upper body support to be rotated upward through intermediate positions to a position perpendicular to the table means.

13. The apparatus of claim 1 wherein the hydraulic cylinders are mounted at an acute angle to the table means.

14. The apparatus of claim 13 wherein the cylinders extend downward and toward a head end of the table means.

15. The apparatus of claim 14, the means for adjusting further comprising means for rotating the cylinders to an inoperative upward position and holding the cylinders in the inoperative upward position.

16. In patient trolley apparatus having a frame, wheels connected to a bottom of the frame and vertical support members connected to the frame and horizontal support members connected to the vertical support members, a patient supporting table means connected to the horizontal support members and an upper body support,hinge means for connecting the upper body support to the patient table means and means for holding the upper body support in angular relationship with the patient table means, the improvement comprising an auxiliary frame connected to the apparatus along one end thereof, a hydraulic reservoir and a hydraulic pump mounted on the auxiliary frame, first and second ram mounting means mounted on opposite sides of the table means, first and second pivot pin means respectively connected to the ram mounting means, first and second hydraulic cylinders respectively connected to the first and second pivot means, first and second pistons mounted in the cylinders, the pistons having distal ends respectively interconnected to the upper body support, hydraulic lines interconnecting the cylinders and the pump and quick-release valve means connected the hydraulic lines for releasing pressure in the cylinders to immediately drop the upper body support, wherein the upper body support is interconnected to distal ends of the pistons by first and second levers and first and second slides respectively connected to levers, each lever comprising a proximal end pivotally connected to a side of the table means and a distal end for connecting via the slide means to a side of the upper body support and wherein the distal end of a respective one of the pistons is pivotally connected to the lever intermediate the proximal and distal ends, wherein the slide means comprises a rod having a smooth exterior finish connected to the upper body support and a linear bearing connected to the distal end of each lever and at least partially surrounding the rod.

17. The apparatus of claim 16 wherein the linear bearing assembly comprises a clevis connected to the distal end of each lever, the clevis having opposite holes near distal ends thereof, a bearing trunnion having outward extending pins fitting in the holes and having a bearing insert receiving portion and a linear bearing insert mounted within the bearing insert receiving portion.

18. In patient trolley apparatus having a frame, wheels connected to a bottom of the frame and vertical support members connected to the frame and horizontal support members connected to the vertical support members, a patient supporting table means connected to the horizontal support members and an upper body support, hinge means for connecting the upper body support to the patient table means and means for holding the upper body support in angular relationship with the patient table means, the improvement comprising an auxiliary frame connected to the apparatus along one end thereof, a hydraulic reservoir and a hydraulic pump mounted on the auxiliary frame, first and second ram mounting means mounted on opposite sides of the table means, first and second pivot pin means respectively connected to the ram mounting means, first and second hydraulic cylinders respectively connected to the first and second pivot means, first and second pistons mounted in the cylinders, the pistons having distal ends respectively interconnected to the upper body support, hydraulic lines interconnecting the cylinders and the pump and quick-release valve means connected to the hydraulic lines for releasing pressure in the cylinders to immediately drop the upper body support, wherein the table means comprises first and second longitudinally extending lateral support members and a slab fixed on top of the support members, the slab having lateral edges positioned slightly inward from lateral extremities of the support members and fairings covering the lateral support members and ends of the slab, thereby forming longitudinally extending passages between the fairings and opposite lateral edges of the slab, and wherein the hydraulic lines are positioned in the passages.

19. The apparatus of claim 18 wherein the hydraulic lines comprise a pump output line having a check valve for permitting flow outward from the pump, a return line connected to the output line outward of the check valve and connected to the reservoir, wherein the quick-release valve is mounted in the return line, a "Y" connection to the output line for connecting first and second parallel lines to the output line, wherein the parallel lines are respectively connected to the first and second cylinders.

20. In a patient trolley having:

an elongated rectangular, patient support table having two short sides and two long sides, a lateral support beam mounted on said table; means for attaching said table to support members for retaining said table in a horizontal position; and an additional upper body support being pivotally attached to said table and being tiltable about a tilting axis parallel to the plane of said table between a horizontal position and elevated positions; the improvement comprising a lifting mechanism for said upper body-support having (a) two telescoping hydraulic cylinders arranged parallel to each other, each comprising a cylinder and a piston rod, said piston rod being movable along its longitudinal axis with respect to said cylinder;

(b) first pivoting means for pivotally mounting each cylinder to one of said long sides of said table in the region of said upper body support, said first pivoting means comprising a collar for holding said cylinder, said collar being pivotally mounted by trunion pins to a bracket having two parallel plates, said plates being connected to said lateral support beam, and said first pivoting means pivoting said cylinder about a first axis which is parallel to said tilting axis;

(c) second pivoting means for pivotally mounting each piston rod to the upper body support, said second pivoting means pivoting said piston rod about a second axis which is parallel to said tilting axis, and which is located approximately half way between said tilting axis and an upper end of said upper body support, whereby said first and second pivoting means are arranged such that said longitudinal axis of said piston rod is inclined with respect to a vertical axis when said upper body support is in horizontal position.

21. The patient trolley of claim 20 wherein the lifting mechanism further comprises:

(d) an auxiliary frame connected to a short side of said table, said auxiliary frame supporting a hydraulic hand pump; and (e) hydraulic lines for connecting said hydraulic cylinders with said hydraulic hand pump.

* * * * *